US009027862B2

(12) United States Patent
Huang

(10) Patent No.: US 9,027,862 B2
(45) Date of Patent: May 12, 2015

(54) SHREDDER THAT PRODUCES CRINKLE PAPER STRIPES

(75) Inventor: Simon Huang, SanChung (TW)

(73) Assignee: Enable International Limited, New Taipei (TW)

( * ) Notice: Subject to any disclaimer, the term of this patent is extended or adjusted under 35 U.S.C. 154(b) by 67 days.

(21) Appl. No.: 13/091,429

(22) Filed: Apr. 21, 2011

(65) Prior Publication Data

US 2012/0267461 A1 Oct. 25, 2012

(51) Int. Cl.

| | |
|---|---|
| ***B02C 7/04*** | (2006.01) |
| ***B02C 18/14*** | (2006.01) |
| ***B02C 18/00*** | (2006.01) |
| ***B31D 5/00*** | (2006.01) |
| ***B02C 18/22*** | (2006.01) |

(52) U.S. Cl.

CPC ..... *B02C 18/142* (2013.01); *B02C 18/0007* (2013.01); *B31D 5/0047* (2013.01); *B02C 18/2216* (2013.01); *B31D 2205/0017* (2013.01); *B31D 2205/0082* (2013.01)

(58) Field of Classification Search

CPC ..... B02C 18/0007; B02C 18/2216; B02C 18/142; B02C 18/164

USPC ..... 241/100, 236, 166

See application file for complete search history.

(56) References Cited

U.S. PATENT DOCUMENTS

| | | | | | |
|---|---|---|---|---|---|
| 5,016,828 | A * | 5/1991 | Utsumi et al. | ..... | 241/158 |
| 5,134,013 | A * | 7/1992 | Parker | ..... | 428/182 |
| 5,910,079 | A * | 6/1999 | Watanabe | ..... | 493/352 |
| 6,089,482 | A * | 7/2000 | Chang | ..... | 241/236 |
| 7,584,912 | B1 | 9/2009 | Jiang | | |
| 2004/0262436 | A1 | 12/2004 | Lo | | |
| 2006/0038048 | A1 | 2/2006 | Lo | | |
| 2007/0023552 | A1 * | 2/2007 | Easton et al. | ..... | 241/100 |
| 2008/0099590 | A1 | 5/2008 | Matlin | | |
| 2010/0213300 | A1 | 8/2010 | Matlin et al. | | |

OTHER PUBLICATIONS

Non-Final Office Action dated Oct. 2, 2014 in U.S. Appl. No. 13/767,842.

* cited by examiner

*Primary Examiner* — Faye Francis
*Assistant Examiner* — Chwen-Wei Su
(74) *Attorney, Agent, or Firm* — Venable LLP; Stefan Kirchanski

(57) ABSTRACT

The invention relates to a paper processing product and, in particular, to a shredder that crinkles paper stripes. The shredder has a shaft set driven by a motor. The shaft set includes at least two shafts rotating in opposite directions. Cutting blade sets are mounted on the shafts. Paper enters the entry of a paper passage formed by the shafts, and gets shredded into chips by the cutting blades. Since the exit of the paper passage is provided with a movable stopper, paper stripes are pushed by the rotating cutting blades to pass the stopper and become crinkled. The stopper is triggered to open by a certain force, letting the paper stripes fall. In addition to the functions of a usual shredder, the paper stripes thus made can be recycled.

10 Claims, 21 Drawing Sheets

SHREDDER THAT PRODUCES CRINKLE PAPER STRIPES

BACKGROUND OF THE INVENTION

1. Field of Invention

The invention relates to a shredder and, in particular, to a shredder whose paper stripes can be recycled.

2. Related Art

If waste paper in daily life is not properly processed, it will bring troubles to our tasks or even result in serious outcomes to the management. A traditional way is to burn the paper. This does not require a place for the furnace, but also cause serious air pollution. To avoid this, various kinds of shredders have been invented.

The shredder usually consists of a paper stripe bin and a shredding head. The shredder has a high-speed motor connected with a rigid gearbox, thereby transmitting the torque to two blade sets. The cutting blades on the blade set thus shred paper into chips. The cutting blades of the blade sets are disposed along two shafts. Once paper is cut by the cutting blades, the chips fall down through the exit of the shredder. That is, the paper stripes fall directly between the two shafts.

Although shredders bring us a lot of convenience, it is a waste to throw away the paper stripes they produce. It is therefore the objective of the invention to make further use of the paper stripes.

SUMMARY OF THE INVENTION

An objective of the invention is to provide a shredder that can recycle the shredded paper stripes thereof.

To achieve the above-mentioned objective, a first embodiment is the following. The shredder has a shaft set driven by a motor. The shaft set includes at least two shafts rotating in opposite directions. The shafts are mounted with blade sets. Paper enters via the entry of the paper passage formed between the shafts, and gets cut into chips by the blade sets. A movable or fixed stopper is provided at the exit of the paper passage. The paper stripes are pushed down by the rotating blade sets toward the exit. The stopper forms crinkles on the paper stripes by blocking them. The stopper is triggered to open under a certain force from the accumulated paper stripes, letting the crinkled paper stripes fall down. When the shredder is in the reverse mode, the clearing mechanism can be triggered by the sliding switch hat or the reversing power of the shredder. The stopper opens the paper exit under the action of the spring or the reversing mechanism of the shredder. In this case, paper is smoothly backed out without the pressure of the stopper. After the reversal is over, the sliding switch hat is put at any position other than reverse. The stopper is driven by a restoring mechanism to automatically restore its position via a mechanical restoring button or the forwarding power of the shredder.

In the first embodiment, the blade set includes: blades mounted on the corresponding shaft and spacers between each two adjacent blades. The paper passage is a passage formed by two opposite side surfaces of left and right guiding boards.

There are two types of spacers on the shafts: one having the same width as the width of paper stripes, and the other having a smaller width than the width of paper striped. These two types of spacers and the cutting blades are mounted alternately. The circumference of the cutting blade is formed with local bumps to increase the friction between the blades and the paper. The paper thus falls smoothly during the cutting process. Moreover, the cutting blades can be made smaller to reduce the production cost.

In the first embodiment, the left and right guiding boards are between the two shafts and each of them is integrally formed. There are grooves on the two opposite side surfaces for cutting blades to extend out. The guiding boards corresponding to the thin spacers can prevent paper jams in the cutting blades. The side surfaces at the paper exit of the left and right guiding boards can be made to have planar, wavy, or horn shape. Alternatively, each of the left and right guiding boards consists of several guiding units. The guiding units are mounted on the spacers of the shafts.

There are three schemes for the clearing mechanism. The first scheme is manual. The components include a sliding switch hat, a pulling bar, a transmission shaft, a lock, a stopper, a restoring switch, a pulling spring, and a torsional spring. The motion of the clearing mechanism can be rotational or translational. The power of the clearing mechanism can be a spring with an elastic potential. The restoring switch is a knob or button. The second scheme is semi-automatic. The components include a sliding switch hat, a pulling bar, a transmission shaft, a lock, a connecting bar, a cam, a pulling spring, and a restoring spring. The stopper is manually opened. Otherwise, the shafts drive the cam and the pulling bar to automatically close the stopper. The third scheme is fully automatic. The reversal of the shafts opens the stopper, and the forward rotation thereof closes the stopper. In one embodiment, the components include a pulling claw, a pulling bar, a spiral guiding groove, and a guiding chip. In a second embodiment, the components include a pulling claw, a pulling bar, and a one-way bearing. In a third embodiment, the components includes a forward claw, a reverse claw, a pawl, a pulling bar, and a restoring spring.

In the first embodiment, the clearing mechanism includes a sliding switch hat, a pulling bar, a transmission shaft, a lock, a stopper, a restoring switch, a pulling spring, and a torsional spring. The clearing mechanism performs a rotational or translational motion. The clearing mechanism is powered by a spring with an elastic potential or a power source through a gearbox. The restoring switch is a knob or button.

In a second embodiment of the invention, the shredder has a shaft set driven by a motor. The shaft set has at least two shafts rotating in opposite directions and with cutting blade sets mounted thereon. Paper enters the entry of a paper passage and is cut by the cutting blades into paper stripes. Paper feeding devices are provided under the exit of the paper passage. The paper feeding devices include two rollers operating in opposite directions and an elastic stopper at the exit of the two rollers. The paper stripes enter the entry of the two rollers of the paper feeding device and move toward the exit under the push of the rollers. The paper stripes are crinkled by the elastic stopper. The accumulated paper stripes push the elastic stopper open.

In the second embodiment, two paper feeding devices are disposed under the exit of the paper passage in a symmetrical way. The paper stripes out of the exit of the paper passage are guided by the guiding surfaces of left and right guiding boards into the two paper feeding devices.

In a third embodiment of the invention, the shredder has a shaft set driven by a motor. The shaft set has at least two shafts rotating in opposite directions and with cutting blade sets mounted thereon. Paper enters the entry of the paper passage between the shafts, and is cut by the cutting blades into paper stripes. The paper passage is formed by two opposite side surfaces of left and right guiding boards mounted on the shafts. A stopper is formed on each of the left and right guiding boards to block the exit of the paper passage. The paper stripes are pushed down by the rotating blades toward the exit. The stoppers form crinkles on the paper stripes. The stoppers open under the accumulated weight of the paper stripes or the trigger of a driving mechanism.

In the third embodiment, the blade set includes: blades mounted on the corresponding shaft and spacers between each two adjacent blades. The left and right guiding boards are mounted on the spacers.

In the third embodiment, the left and right guiding boards are formed with protrusions to urge against the elastic element. The paper stripes are pushed down by the blade sets toward the exit and crinkled by the two stoppers. The accumulated weight thereof overcomes the stopping force of the elastic element on the protrusions, thereby pushing the stoppers open.

In the third embodiment, the left and right guiding boards are formed with bumps connected with a driving mechanism. The driving mechanism drives the left and right guiding boards to swing through the connections with the bumps, thereby opening or closing the stoppers.

In addition, the invention proposes rolling paper designed for the above-mentioned shredder. The rolling paper is formed with alternating cuts. The rolling paper can be continuous listing paper.

According to the invention, the motor drives a long shaft and a short shaft through decelerating gears. Cutting blades on the shafts cut paper into chips. The paper stripes move downward through the paper passage between the shafts. An elastic chip or stopper is disposed at the paper exit. The paper stripes are crinkled by the blocking of the elastic chip or stopper. They can also be crinkled between the guiding boards and blades. Such crinkled paper stripes become resilient. The invention can be made small for mass production. Moreover, the crinkled paper stripes thus obtained are resilient and suitable for packaging and transportation. Therefore, the invention recycles waste paper and thus protects our environment.

BRIEF DESCRIPTION OF THE DRAWINGS

These and other features, aspects and advantages of the invention will become apparent by reference to the following description and accompanying drawings which are given by way of illustration only, and thus are not limitative of the invention, and wherein.

DETAILED DESCRIPTION OF THE INVENTION

Figure 1:
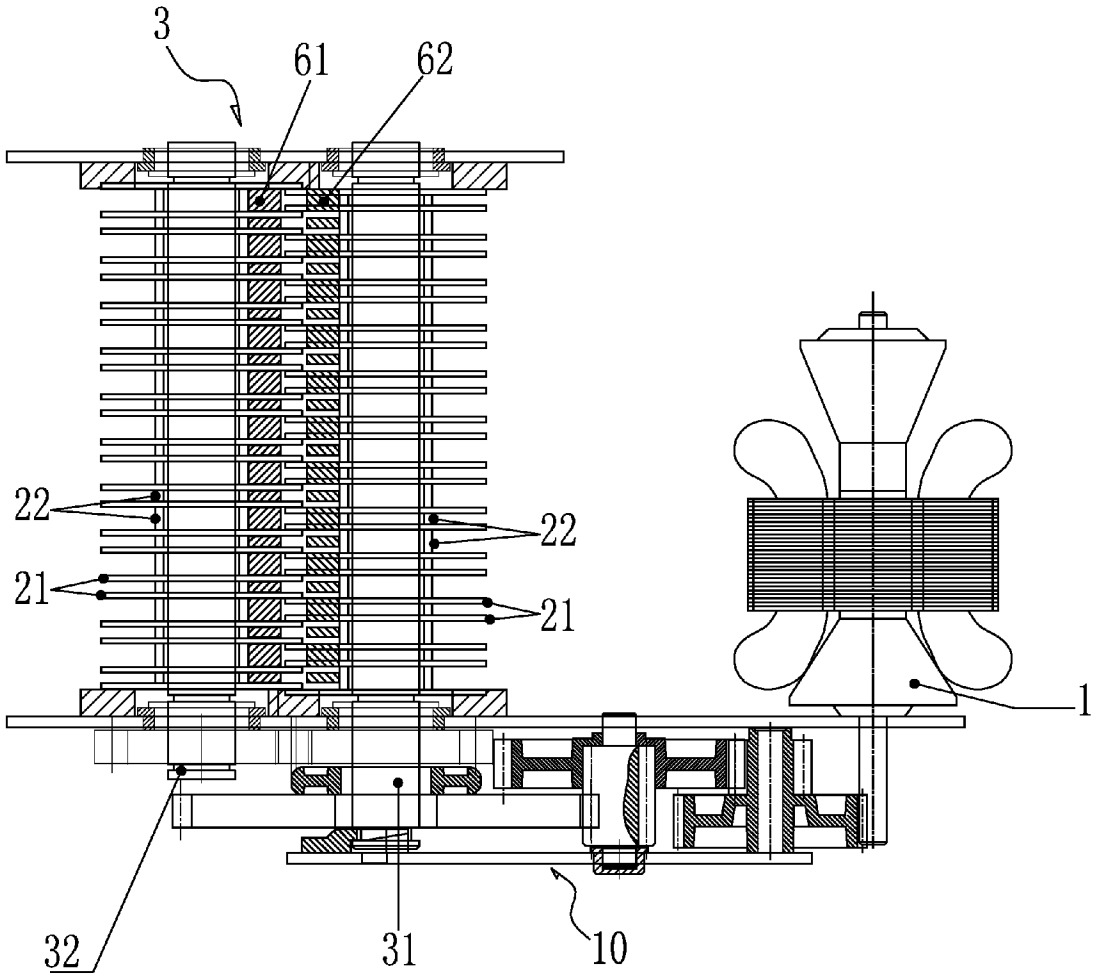
FIG. 1 is a top view showing the structure of the first embodiment of the invention.
Figure 2:
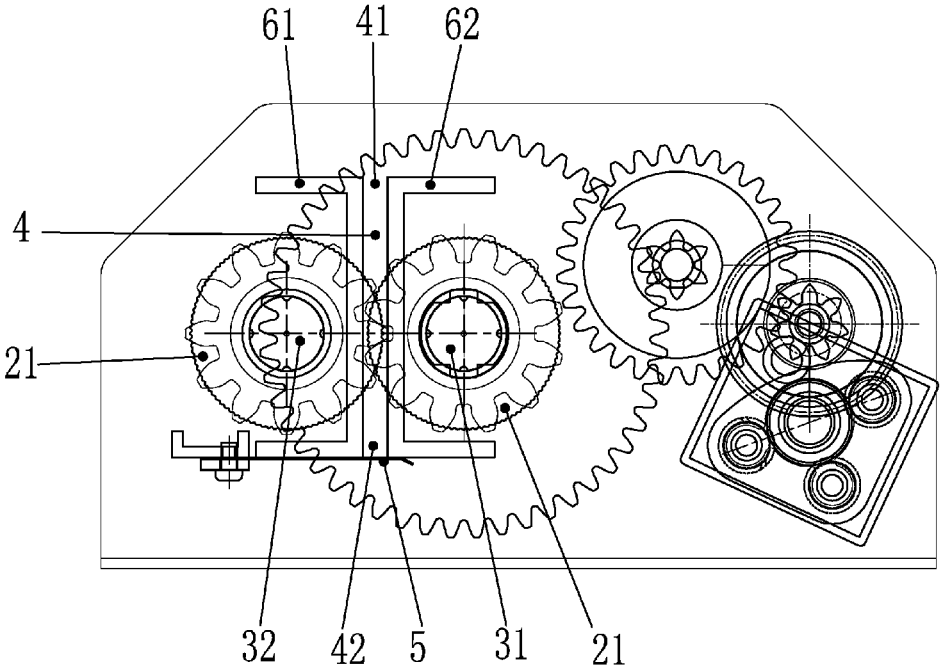
FIG. 2 is a side view of the first embodiment.

The present invention will be apparent from the following detailed description, which proceeds with reference to the accompanying drawings, wherein the same references relate to the same elements.

Please refer to FIGS. 1, 2, 3, 4, 23, 25, 27, 28, 30, 31, 33, 34, 36 and 37 for a first embodiment of the invention. It includes: a motor 1, a gear decelerating mechanism 10 connected to the motor 1, a shaft set 3, cutting blades fixed on the shaft set 3, and a clearing mechanism.

The shaft set 3 in this embodiment includes one long shaft 31, and one short shaft 32. The shafts 31, 32 rotate synchronously via gears. The motor 1 drives the long shaft 31 through the gear decelerating mechanism 10. Thus, the two shafts rotate concurrently in opposite directions.

The shafts 31, 32 are mounted with blade sets. Each of the blade sets includes: cutting blades 21 mounted on the shaft 31 or 32 and spacers 22*a*,22*b* between each two adjacent cutting blades 21. The width of the spacer 22*a* is the same as that of the paper striped. The width of the spacer 22*b* is smaller than that of the paper stripes. The cutting blades 21 on the two shafts are arranged to provide a cutting effect, cutting paper 9 between the two shafts 31, 32 into paper stripes 91. The cutting blade 21 can be designed to have different shapes, as shown in FIGS. 4*a* to 4*d*. The circumference of the cutting blade is formed with local bumps to increase the friction between the blades and the paper. The paper thus falls smoothly during the cutting process. Moreover, the cutting blades can be made smaller to reduce the production cost.

A paper passage 4 is formed between the two shafts 31, 32. In this embodiment, the paper passage 4 is a passage formed by two opposite side surfaces of left and right guiding boards 61, 62. The paper 9 enters via the entry above the paper passage 4. The paper stripes 91 come out of the exit 42 at the lower end of the paper passage 4. An openable stopper 5 is disposed at the exit 42 to block the exit 42.

Figure 3:
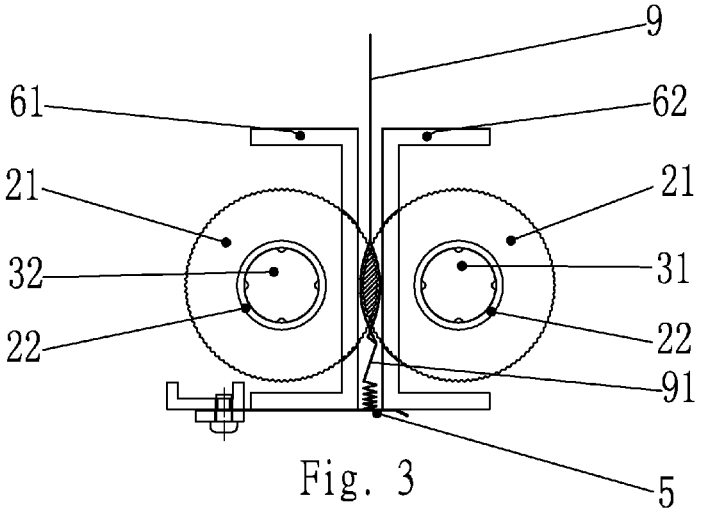
FIG. 3 shows the structure of the first embodiment.
Figure 22:
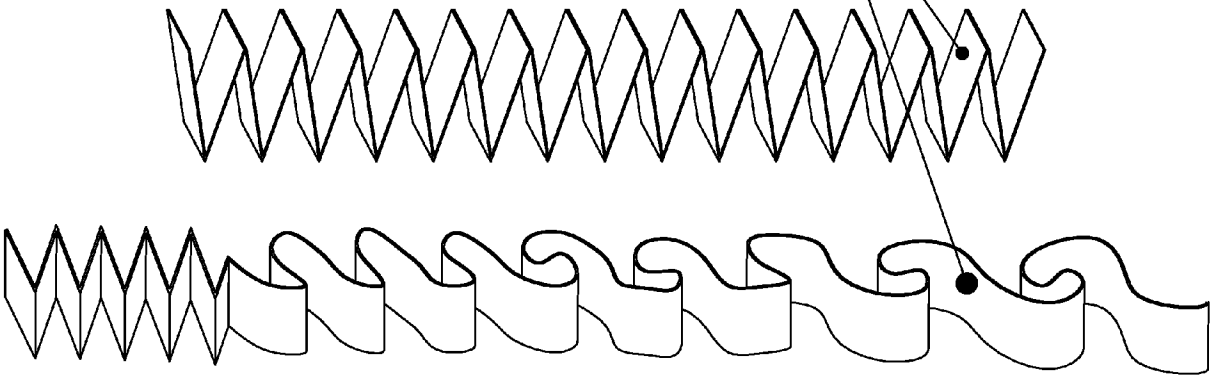
FIG. 22 shows the crinkled paper stripes produced by the disclosed shredder.
Figure 24:
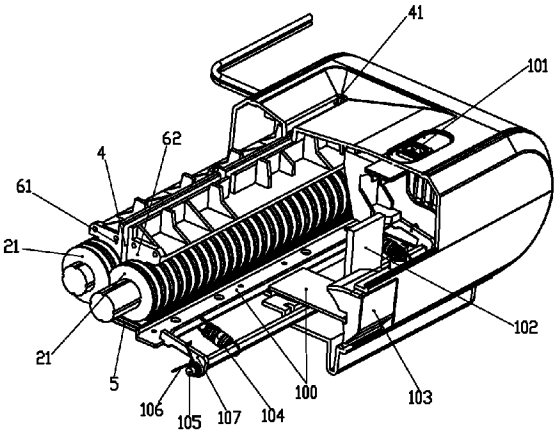
FIG. 24 is a three-dimensional view showing that the elastic chip in the manual clearing mechanism is closed.
Figure 23:
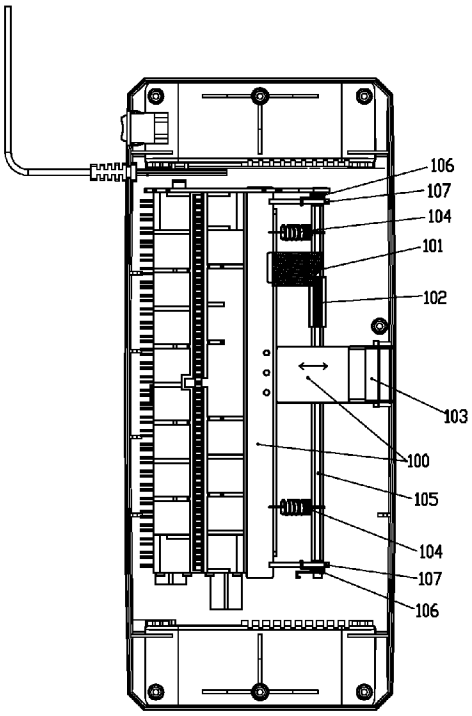
FIG. 23 schematically shows that the elastic chip in the manual clearing mechanism is closed.
Figure 23:
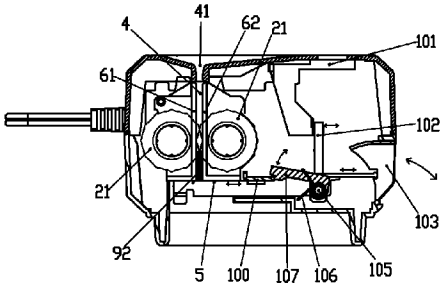
Figure 25:
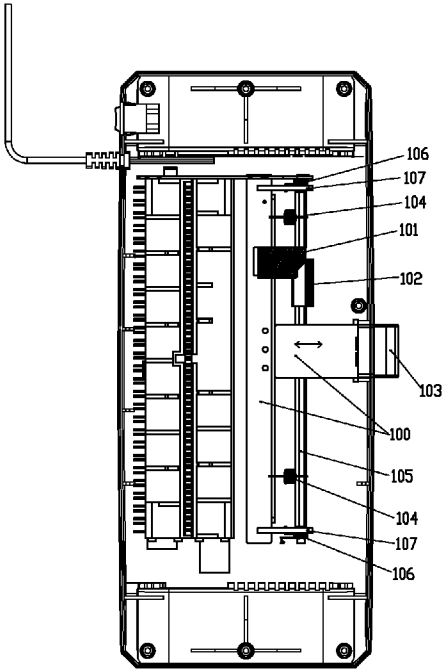
FIG. 25 schematically shows that the elastic chip in the manual clearing mechanism is opened.
Figure 25:
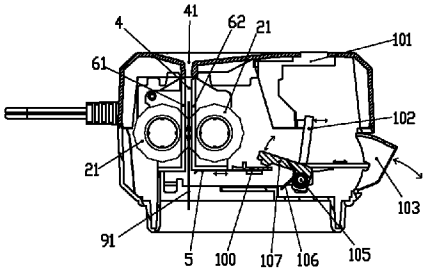
Figure 26:
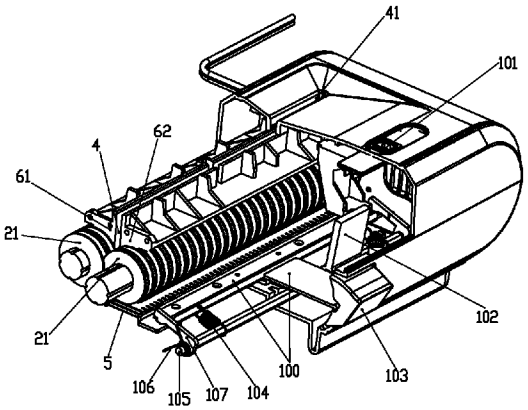
FIG. 26 is a three-dimensional view showing that the elastic chip in the manual clearing mechanism is opened.

With reference to FIGS. 3 and 22, paper 9 enters the entry 41 of the paper passage 4 formed by the shafts 31, 32, and is cut by the blade sets into paper stripes 91. A stopper 5 is disposed at the exit 42 of the paper passage 4. The paper stripes 91 are pushed by the rotating blade sets toward the exit 42, and experience resistance. The paper stripes 91 are crinkled in this space. Once the paper stripes 91 are accumulated to a certain extent, its pressure pushes the stopper 5 open. The crinkled paper stripes 92 thus fall out of the exit 42.

Figure 4:
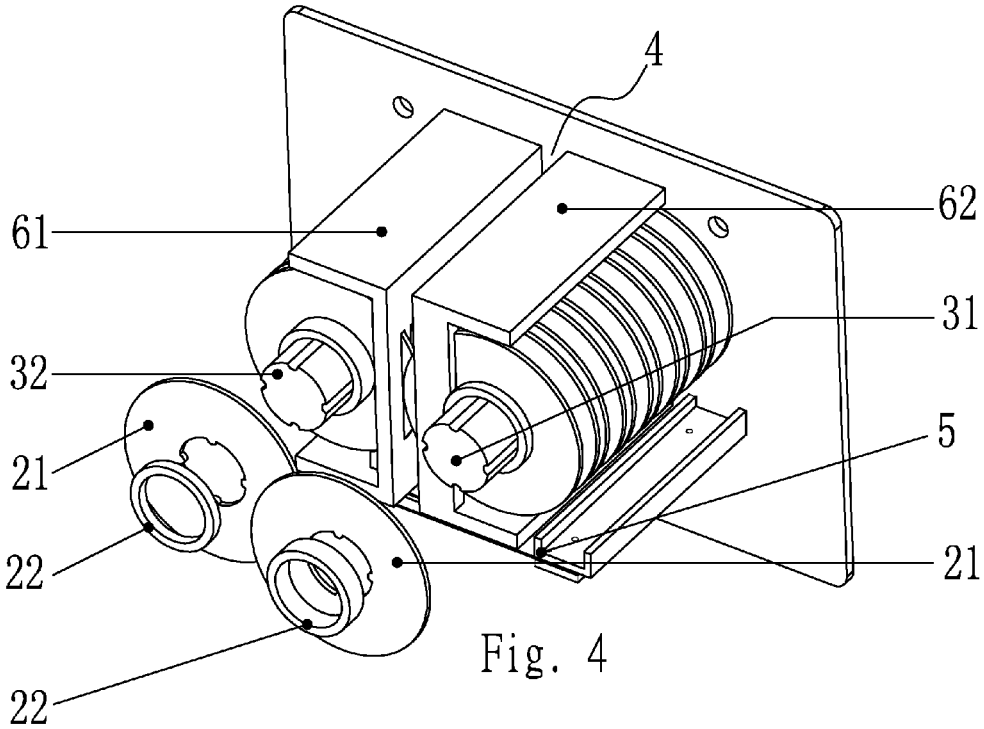
FIG. 4 is a three-dimensional view of the shaft set in the first embodiment.
Figure 4A:
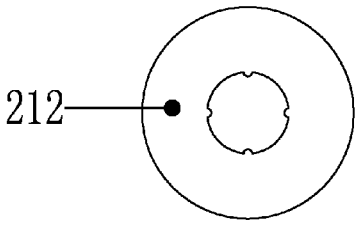
FIGS. 4*a* to 4*d* are schematic views of the first embodiment with different kinds of cutting blades.
Figure 4B:
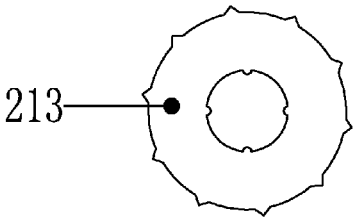
Figure 4C:
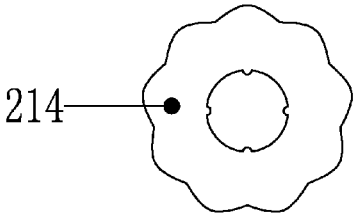
Figure 4D:
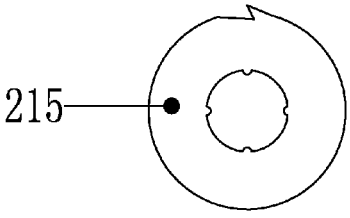

The left and right guiding boards 61, 62 are located between the two shafts 31, 32. Each of the left and right guiding boards 61, 62 is integrally formed. The two opposite side surfaces are formed with grooves for the cutting blades 21 to extend out, as shown in FIG. 4. The guiding boards 61*a*, 62*a* can prevent paper jams at the cutting blades.

Figure 5:
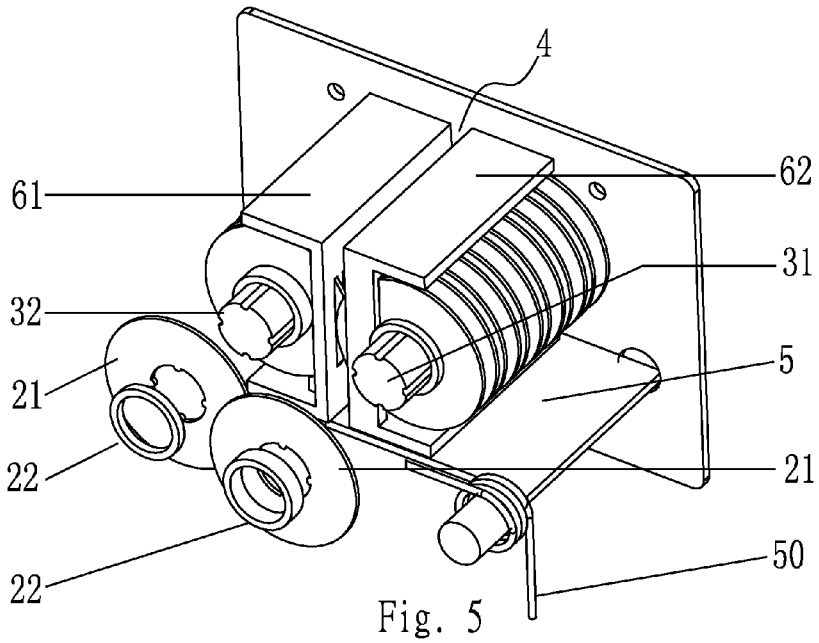
FIG. 5 is a schematic view showing that the stopper is closed in the first embodiment.
Figure 6:
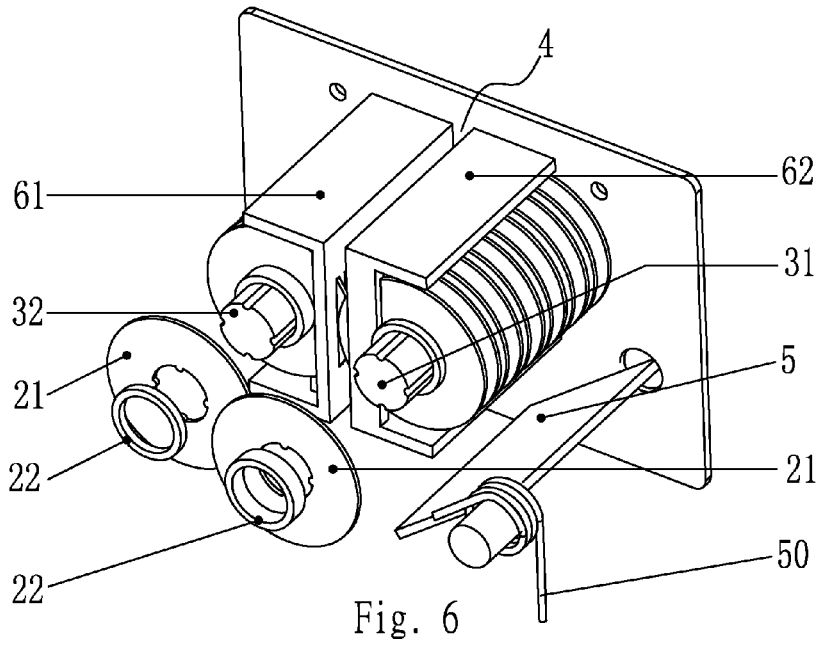
FIG. 6 is a schematic view showing that the stopper is open in the first embodiment.
Figure 7:
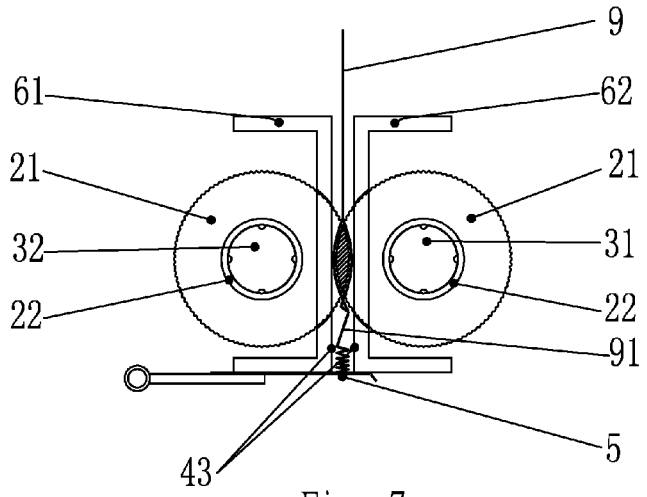
FIG. 7 is a schematic view showing how the first embodiment works.

The stopper 5 is an elastic object. Under its own elasticity, the stopper 5 blocks the exit 42 of the paper passage 4. It is pushed open under the gravity of the paper stripes 91 accumulated in the paper passage 4. The elasticity of the stopper 5 can be due it its material, as shown in FIGS. 3 and 4. It can also be implemented by adding a torsional spring 50. As shown in FIGS. 5, 6, 7, the rotating axis of the stopper 5 is disposed with a torsional spring 50 to implement the elasticity on the stopper 5. The stopper 5 can rotate a certain angle so that the exit 42 of the paper passage 4 is completely open or closed.

Besides, the stopper 5 can be installed with a moving device. The moving device enables the stopper 5 to rotate to translate, thereby completely opening the exit 42. In this case, the paper stripes 91 in the paper passage 4 experience no resistance, implementing the function of clearing paper. After paper stripes are cleared, the stopper 5 is restored by the moving device.

The stopper 5 can have various kinds of shapes. It is usually a flat board. Of course, it can also have a comb shape.

Figure 8:
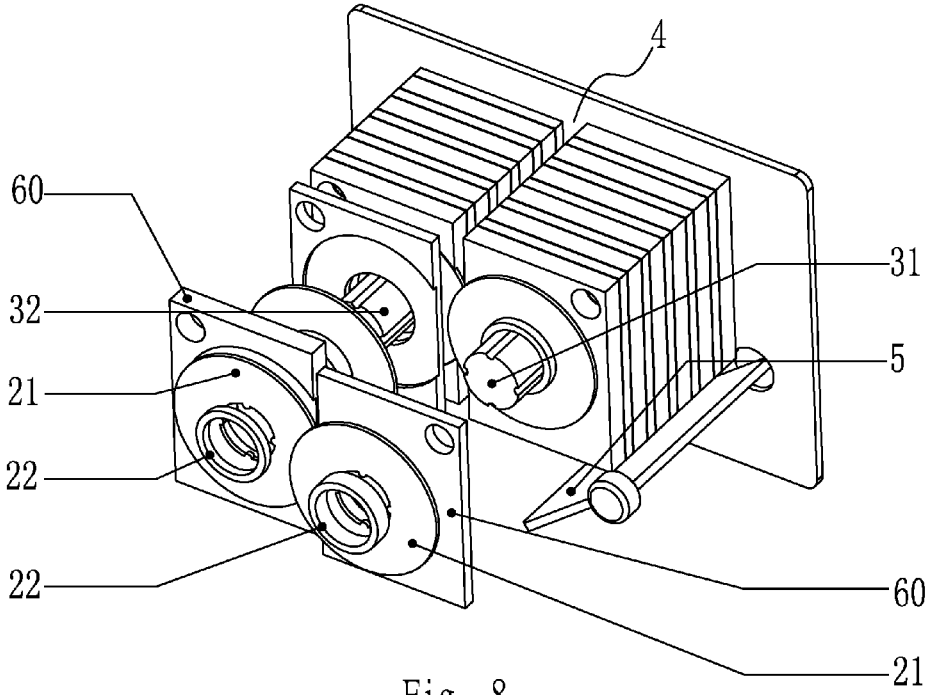
FIG. 8 is another schematic view showing how the first embodiment works.
Figure 9:
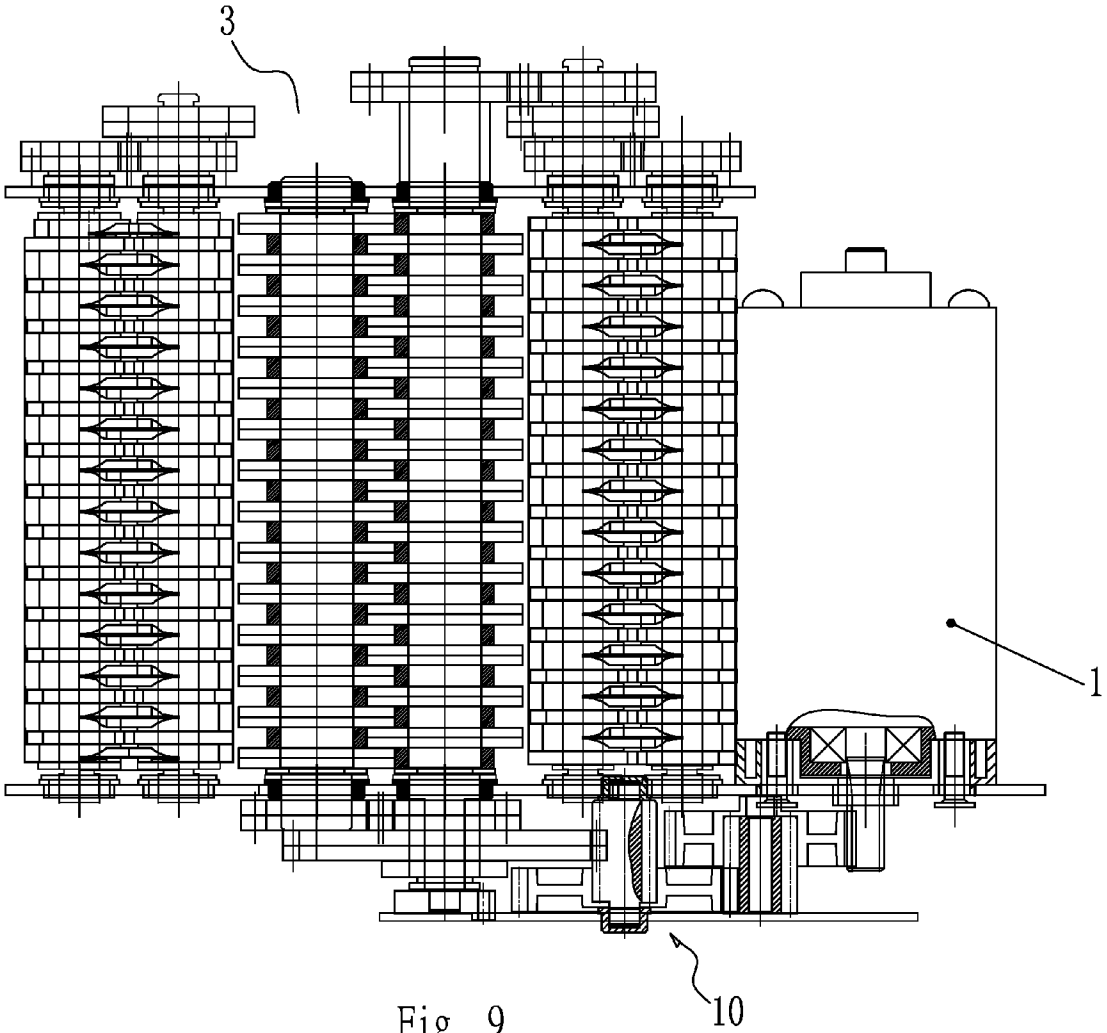
FIG. 9 is a top view of a second embodiment of the invention.

With reference to FIG. 8, the left and right guiding boards 61, 62 can consist of several guiding units 60 as well. The guiding units 60 are mounted on the spacers 22 of the shafts 31, 32. The guiding units 60 on each of the shafts form the paper passage 4.

Please refer to FIGS. 23, 24, 25, and 26. The clearing mechanism consists of a sliding switch hat 101, a pulling bar 102, a transmission shaft 105, a lock 107, a stopper 5, a restoring switch 103, a pulling spring 104, and a torsional spring 106. When the shredder runs in the reverse mode, the sliding switch hat 101 pushes the pulling bar 102 to rotate. This action drives the lock 107 to rotate via the transmission shaft 105. Under the pulling force of the spring, the stopper 5 moves backward to open the paper exit. The restoring switch 103 pops outward. After paper stripes are cleared, the sliding switch is moved to any position other than reverse. By pushing the restoring switch 103, the stopper 5 moves forward and locks. The action of the torsional spring 106 implements the locking by rotating the stopper downward.

Figure 28:
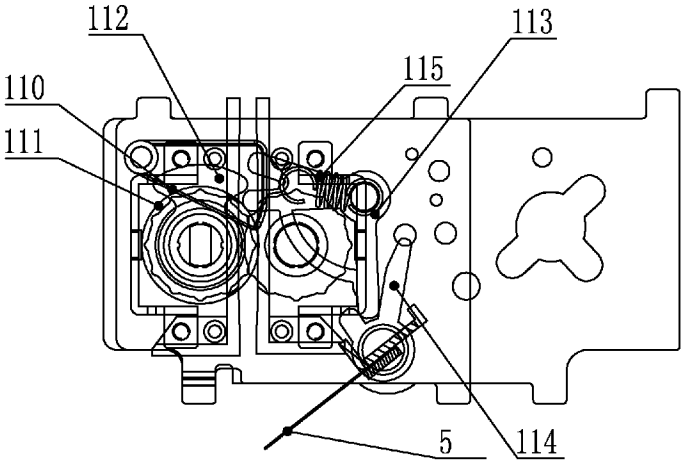
FIG. 28 schematically shows that the elastic chip in the automatic clearing mechanism is opened according to the first embodiment.
Figure 28:
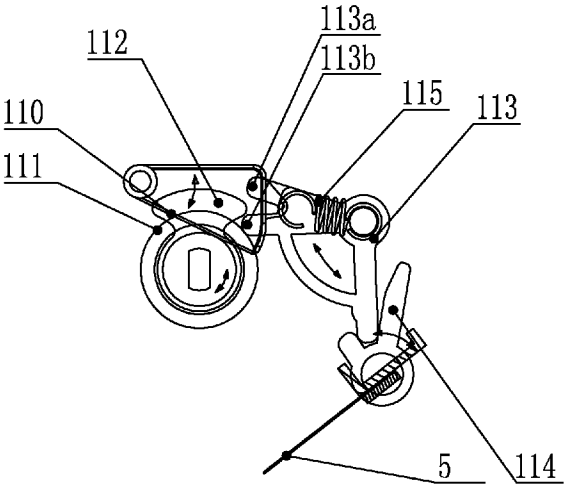
Figure 27:
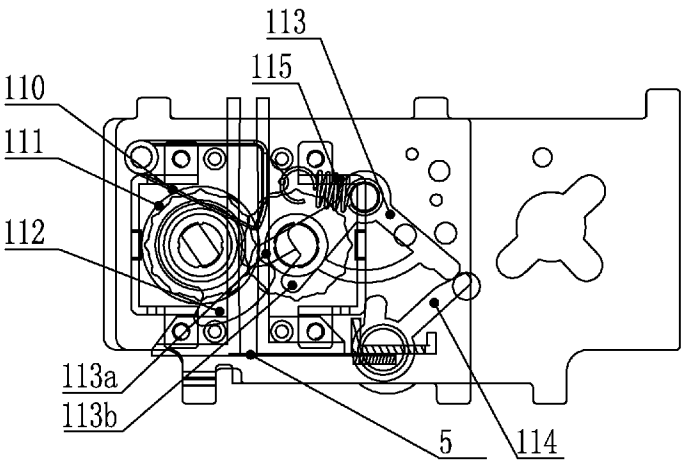
FIG. 27 schematically shows that the elastic chip in the automatic clearing mechanism is closed according to the first embodiment.
Figure 27:
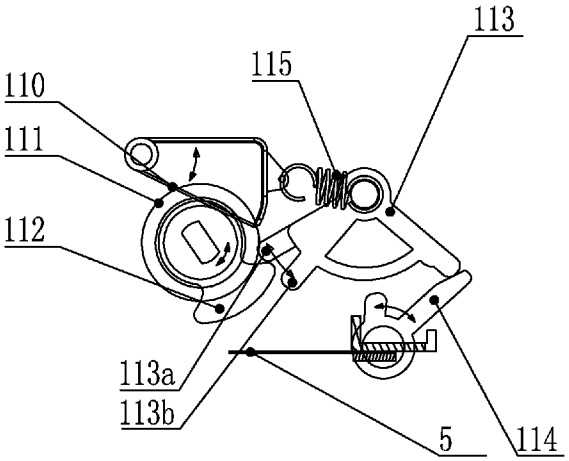
Figure 29:
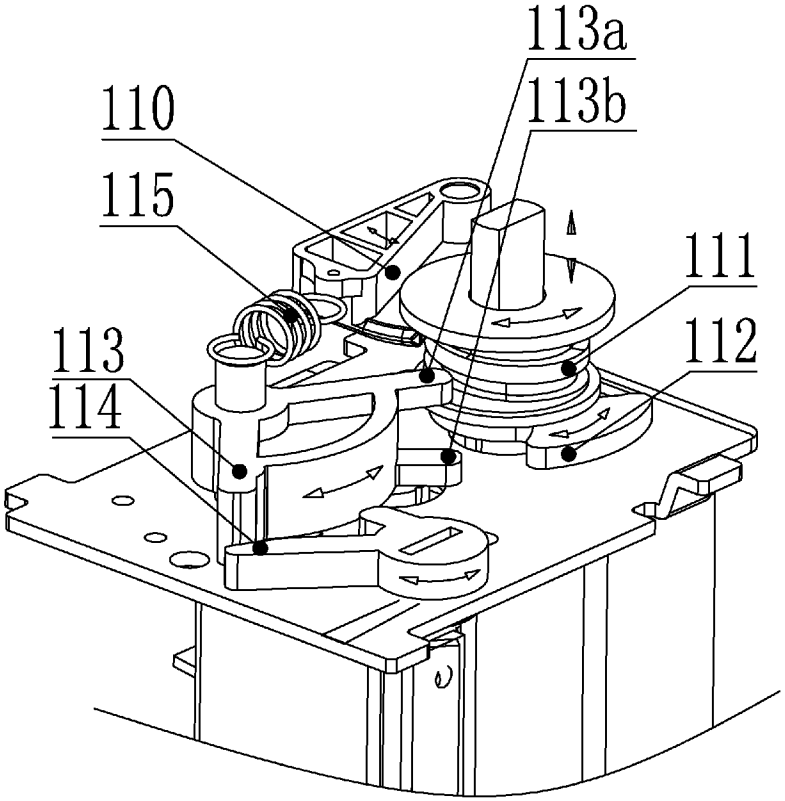
FIG. 29 is a three-dimensional view of the automatic clearing mechanism according to the first embodiment.

Please refer to FIGS. 27, 28, and 29. The clearing mechanism includes a pulling claw 112, a pulling bar 113, a pulling bar 114, a stopper 5, a spiral guiding groove 111, a guiding plate 110, and a pulling spring 115. When the shredder reverses, the spiral guiding groove 111 is driven by the guiding plate 110 to displace the pulling claw 112 outward. When the pulling claw 112 and the pulling bar 113*a* are on the same plane, the pulling claw 112 pushes the pulling bar 113 to rotate clockwise, bringing the pulling bar 114 and the stopper 5 to rotate counterclockwise at the same time. Thus the stopper 5 opens the paper exit. When the shredder runs forward, the spiral guiding groove 111 under the action of the guiding plate 110 displaces the pulling claw 112 inward. When the pulling claw 112 and the pulling bar 113*b* are on the same plane, the pulling claw 112 pushes the pulling bar 113 to rotate counterclockwise, bringing the pulling bar 114 and the stopper 5 to rotate clockwise. The stopper 5 is then in the state to crinkle paper.

Figure 31:
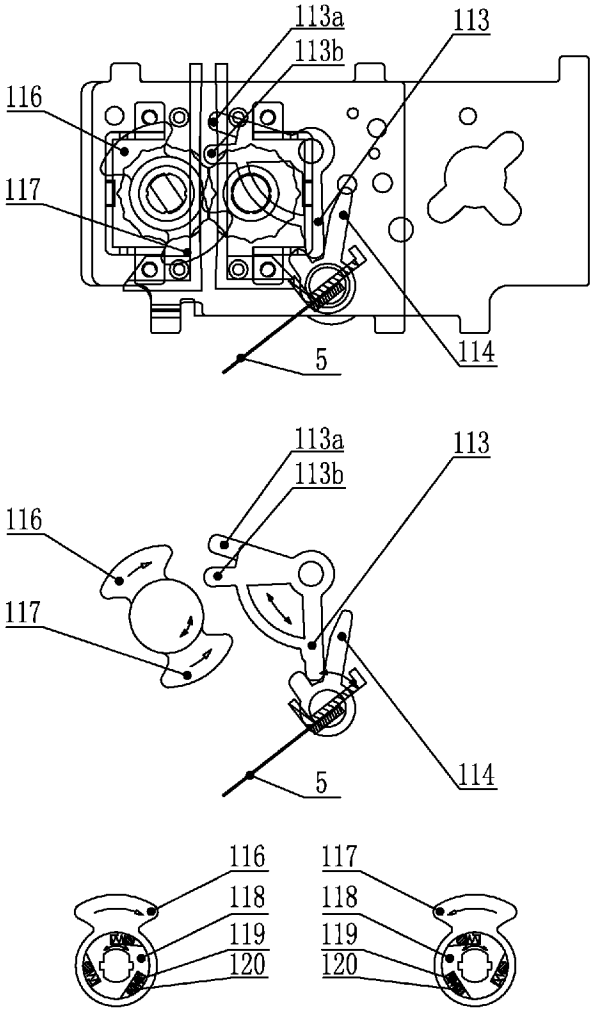
FIG. 31 schematically shows that the elastic chip in the automatic clearing mechanism is opened according to the second embodiment.
Figure 30:
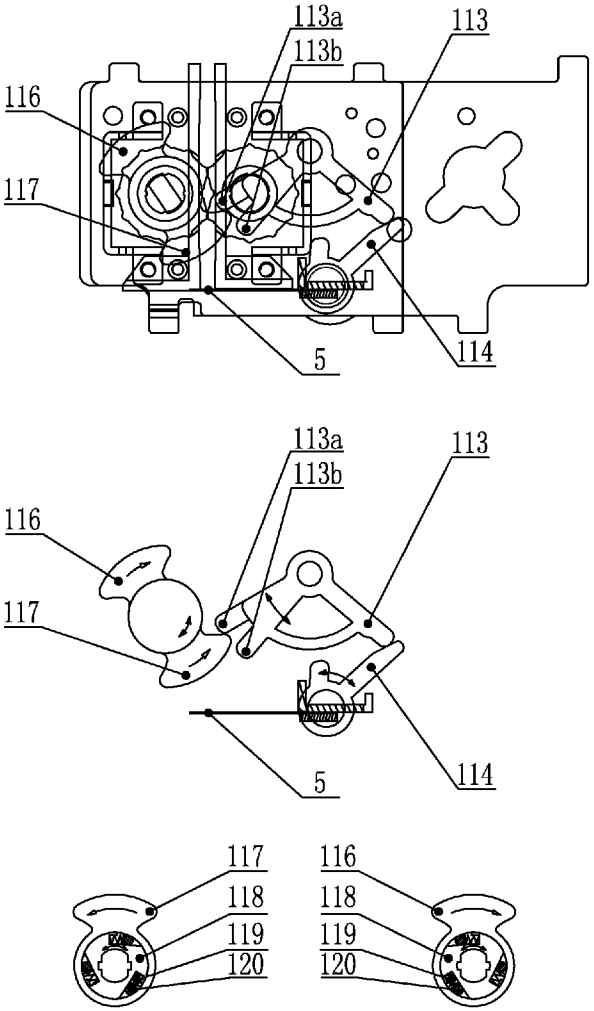
FIG. 30 schematically shows that the elastic chip in the automatic clearing mechanism is closed according to the second embodiment.
Figure 32:
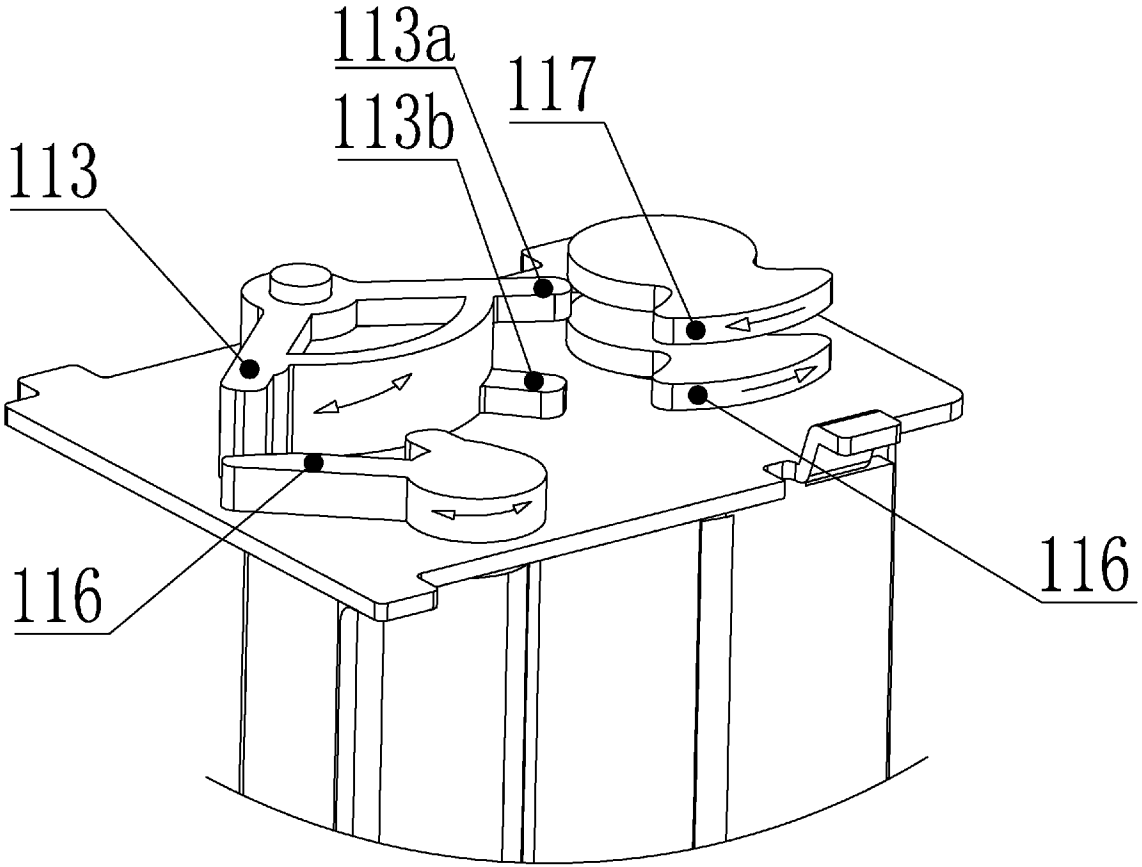
FIG. 32 is a three-dimensional view of the automatic clearing mechanism according to the second embodiment.

Please refer to FIGS. 30, 31, and 32. The clearing mechanism includes a forward pulling claw 116, a reverse pulling claw 117, a pulling bar 113, a pulling bar 114, and a stopper 5. The forward pulling claw 116 has one-way mechanisms 118, 119, 120. The reverse pulling claw 117 has one-way mechanisms 118, 119, 120. The forward pulling claw 116 and the pulling bar 113*b* are on the same plane. The reverse pulling claw 117 and the pulling bar 113*a* are on the same plane. When the shredder reverses, the reverse pulling claw 117 drives the pulling bar 113*a*, the pulling bar 114, and the stopper 5 to rotate, thereby opening the paper exit. When the shredder runs forward, the pulling claw 116 drives the pulling bar 113*b*, the pulling bar 114, and the stopper 5 to rotate. The stopper is then in the state to crinkle paper.

Figure 34:
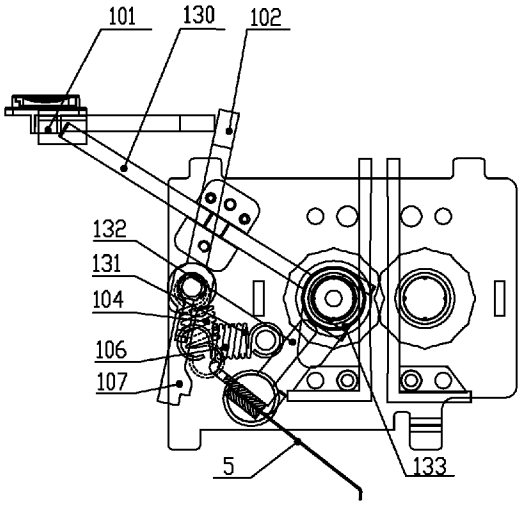
FIG. 34 schematically shows that the elastic chip in the semi-automatic clearing mechanism is opened.
Figure 34:
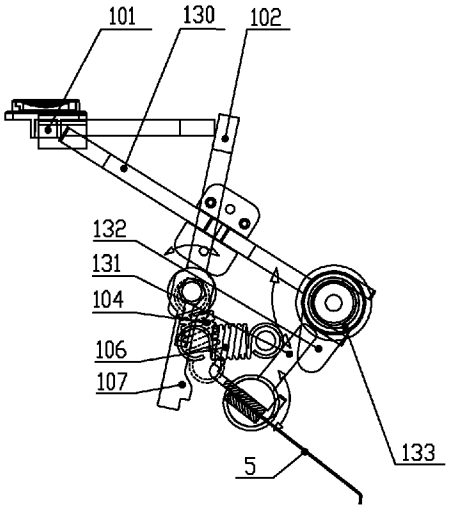
Figure 33:
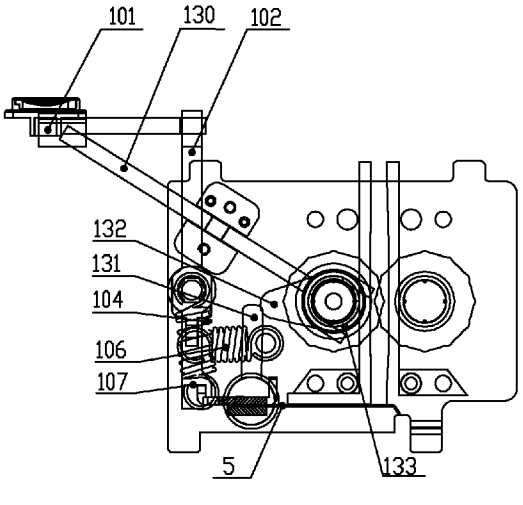
FIG. 33 schematically shows that the elastic chip in the semi-automatic clearing mechanism is closed.
Figure 33:
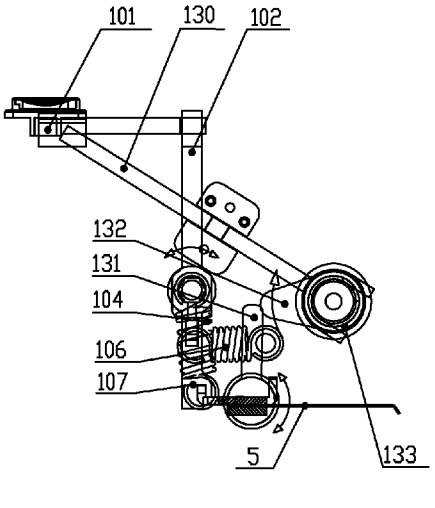
Figure 35:
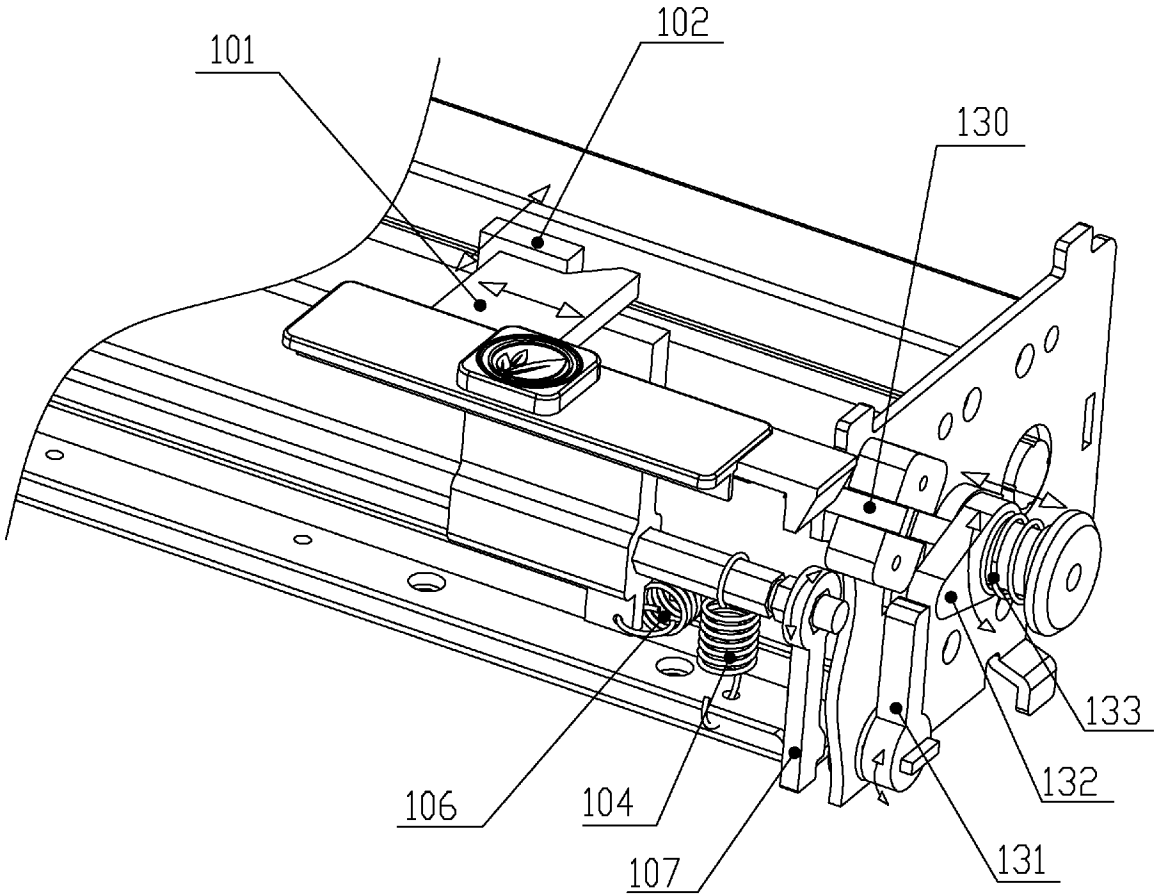
FIG. 35 is a three-dimensional view of the semi-automatic clearing mechanism.

Please refer to FIGS. 33, 34, and 35. The clearing mechanism includes a sliding switch hat 101, a pulling bar 102, a pulling bar 130, a pulling bar 131, a cam 132, a lock 107, pulling springs 104, 106, and a restoring spring 133. When the sliding switch hat 101 is put at the reverse mode, the sliding switch hat 101 triggers the pulling bar 102 to rotate. The lock 107 is then unlocked. The stopper 5 is pulled by the pulling spring 104 to rotate and open the paper exit. At the same time, the sliding switch hat 101 pushes the pulling bar 130 to displace the cam 132 outward. Once the reversal is over and the switch is put at the AUTO mode, the shredder runs forward. The cam 132 is driven by the restoring spring 133 to restore its position and push the pulling bar 131. The stopper 5 thus rotates to close the paper exit, resuming its state of crinkling paper.

Figures 36, 37:
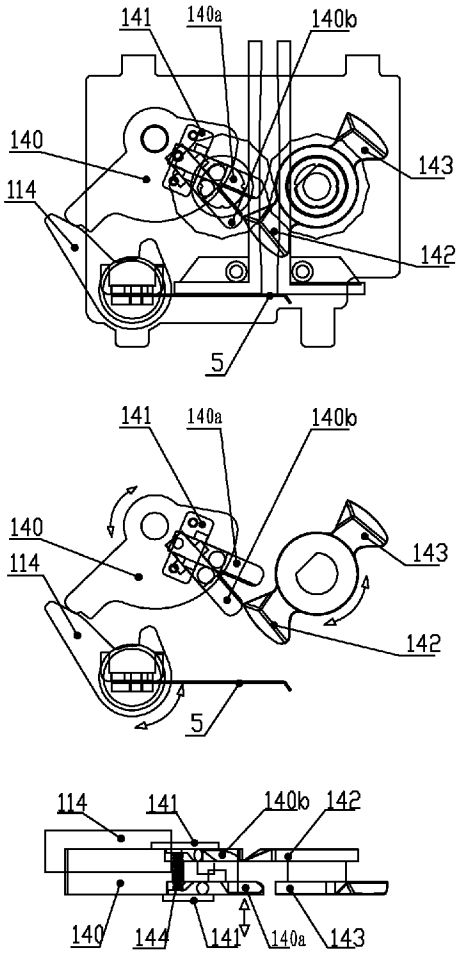
FIG. 36 is a schematic view of a closed stopper according to the third embodiment of the fully automatic shredder.
FIG. 37 is a schematic view of an open stopper according to the third embodiment of the fully automatic shredder.
Figure 38:
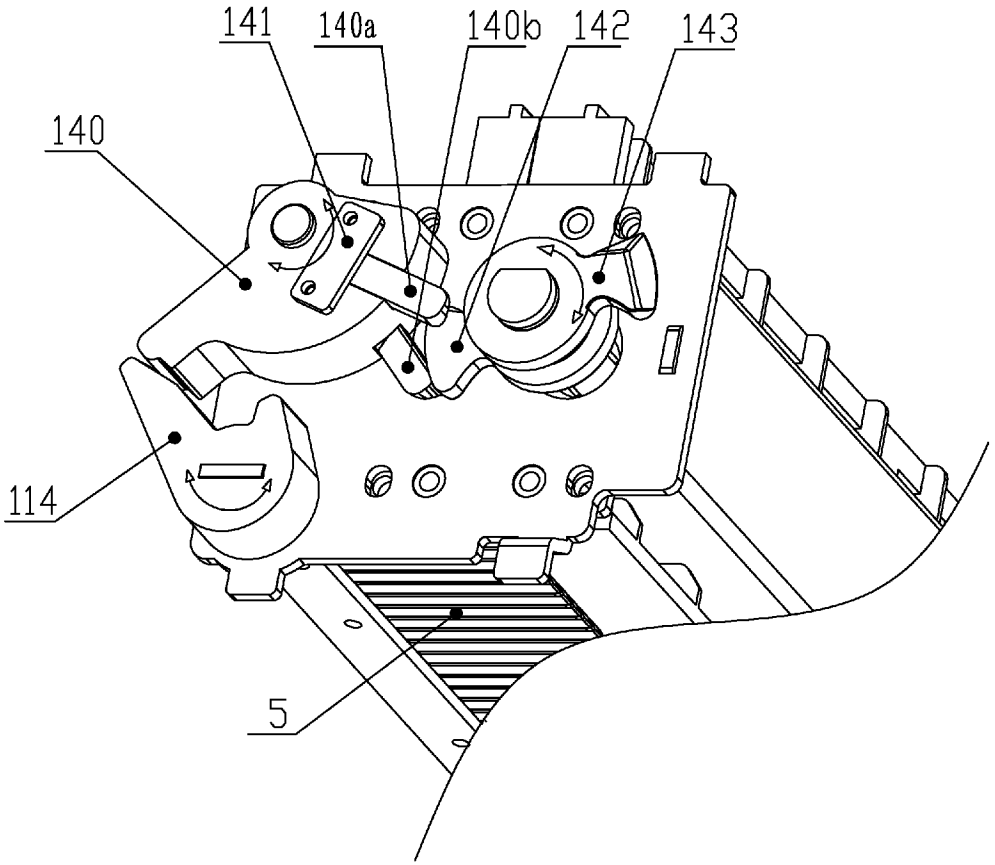
FIG. 38 is a three-dimensional view of the fully automatic shredder.

Please refer to FIGS. 36, 37, and 38. The clearing mechanism includes a forward claw 142, a reverse claw 143, a pulling rod 114, and another pulling rod 140. The pulling rod 140 has one-way pawls 140*a*, 140*b*. The forward claw 142 and the one-way pawl 140*b* are on the same plane. These two elements have slant surfaces facing each other. The reverse claw 143 and the one-way pawl 140*a* are on the same plane. These two elements have slant surfaces facing each other. When the shredder runs forward, the forward claw 142 drives the one-way pawl 140*b*, the pulling rod 140, the pulling rod 114, and the stopper 5 into rotations, closing the stopper 5. In this case, due to the slant surfaces, the reverse claw 143 makes the pawl 140*a* rotate outward, realizing the one-way feature of the reverse claw 143 and the pawl 140*a*. When the shredder runs in reverse, the reverse claw 143 rotates the one-way pawl 140*a*, the pulling rod 140, the pulling rod 114, and the stopper 5, opening the stopper 5. Due to the slant surfaces, the forward claw 142 makes the pawl 140*b* rotate outward, realizing the one-way feature of the forward claw 142 and the pawl 140*b*.

Please refer to FIGS. 9 to 12 for a second embodiment of the invention. Similar to the first embodiment, the present embodiment includes: a motor 1, a gear decelerating mechanism 10 connected to the motor 1, a shaft set 3, and blade sets fixed on the shaft set 3. The blade sets are mounted on the two shafts 31, 32. Each of the blade sets includes: cutting blades 21 mounted on the shaft 31 or 32 and spacers 22 between two adjacent cutting blades 21. A paper passage 4 is formed between the two shafts 31, 32.

A difference is that in the first embodiment, the crinkling process occurs in the paper passage 4. In this embodiment, the crinkling process is accomplished by paper feeding devices 7. The structure is described as follows.

Two paper feeding devices 7 are disposed under the exit 42 of the paper passage 4. The paper feeding devices 7 include a pair of opposite rollers 71 and an elastic stopper 51 at the exit of the two rollers 71. The paper stripes 91 enter the entry of the two rollers 71 of the two paper feeding devices 7. They are pushed by the rollers 71 toward the exit. Through the blocking of the elastic stopper 51, the paper stripes 91 are crinkled. An accumulated pushing force eventually pushes the elastic stopper 51 open.

Figure 10:
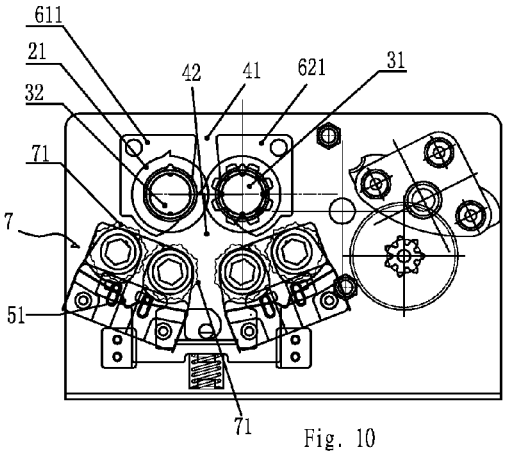
FIG. 10 is a side view of the second embodiment.
Figure 11:
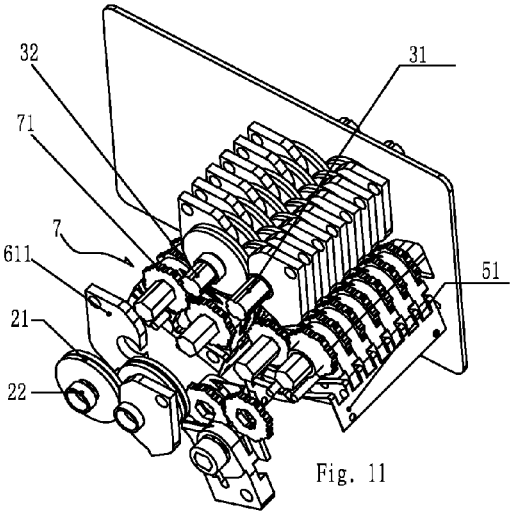
FIG. 11 is a three-dimensional view of the shaft set in the second embodiment.
Figure 12:
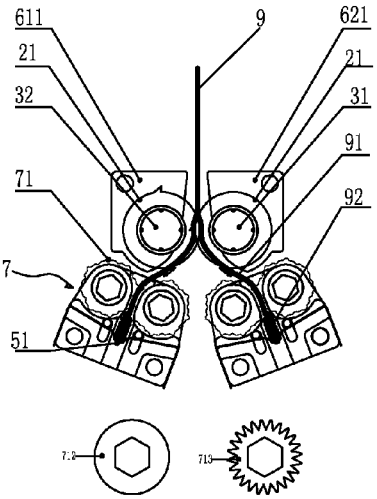
FIG. 12 shows the structure of the second embodiment.

The paper passage 4 is a passage formed by the two opposite side surfaces of the left and right guiding boards 611, 621 mounted on the shafts 31, 32. The side surface of the paper passage 4 formed by the left guiding board 611 has a guiding curved surface toward the left paper feeding device 7. The side surface of the paper passage 4 formed by the right guiding board 621 has a guiding curved surface toward the right paper feeding device 7. The reason for this structure, as shown in FIG. 10, is that the two paper feeding devices 7 form a V shape under the exit 42. In order for the paper stripes 91 to enter the paper feeding devices 7, respectively, the two opposite side surfaces of the left and right guiding boards 611, 621 are made into smooth guiding curved surfaces. Once paper stripes 91 are formed, they are driven by the cutting blades 21 and their own tension to proceed along two directions. They then follow the corresponding guiding curved surfaces to enter the two paper feeding devices 7.

According to the embodiment, the paper stripes 91 formed by the cutting blades 21 are divided into two parts via the left and right guiding boards 611, 612 to enter the corresponding underneath paper feeding devices 7. Since the paper feeding devices 7 have a pair of oppositely running rollers 71, the paper stripes 91 are driven by the rollers 71 downward. When the paper stripes 91 reach the elastic stopper 51, they are crinkled between the elastic stopper 51 and the rollers 71 due to resistance. The paper stripes become resilient crinkle paper 92. The accumulated resilient force eventually pushes the elastic stopper 51 open, and the resilient crinkle paper 92 drops out.

As in the first embodiment, the elastic stopper 51 in the second embodiment can open through a rotational or translation motion. The paper stripes 91 can directly escape without any resistance, thereby clearing the paper. After the paper is cleared, the elastic stopper 51 restores its position by rotation or translation. Besides, the material of the rollers 71 can be metal, plastic, or rubber. There can also be several sets of rollers 71.

Figure 13:
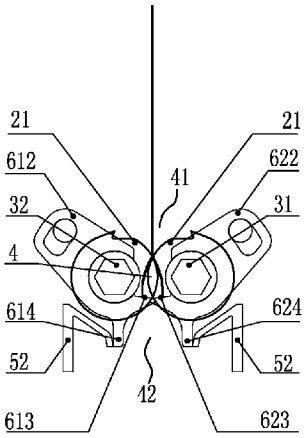
FIGS. 13 and 14 shows how the third embodiment of the invention works.
Figure 14:
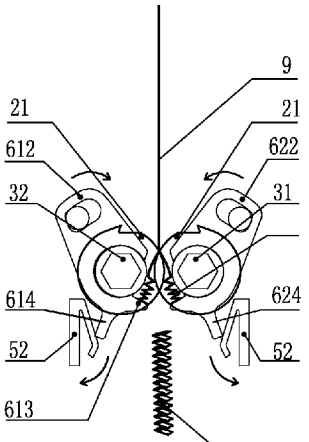
Figure 15:
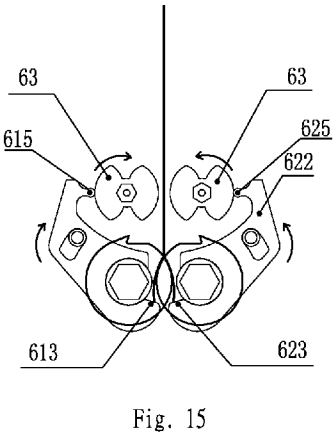
FIGS. 15 and 16 shows how the fourth embodiment of the invention works.
Figure 16:
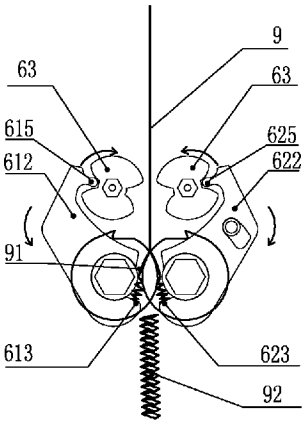

Please refer to FIGS. 13 and 14. The primary structure of this embodiment is the same as the previous two embodiments and is not further described. The only difference is the following. The paper passage 4 is formed by the two opposite side surfaces of the left and right guiding boards 612, 622 mounted on the shafts 31, 32. Stops 613, 623 are formed on the left and right guiding boards 612, 622 to block the exit 42 of the paper passage 4. The paper stripes 91 are pushed by the blade sets toward the exit 42, and crinkled due to the blocking of the two stoppers 613, 623. A force is accumulated to eventually open the stoppers 613, 623.

The blade set in this embodiment includes cutting blades 21 mounted on the shafts 31, 32 and the spacers 22 between two adjacent cutting blades 21. The left and right guiding boards 612, 622 are mounted on the spacers 22 in a rotatable way. The left and right guiding boards 612, 622 are formed with protrusions 614, 624, respectively. The protrusions 614, 624 urge against the elastic element 52. The paper stripes 91 are pushed by the blade sets toward the exit 42. They form crinkles by the blocking of the two stoppers 613, 623. A force is accumulated to eventually overcome the blocking force of the elastic element 52 on the protrusions 614, 624 and push the stoppers 613, 623 open. The resilient crinkled paper 92 thus falls between the two stoppers 613, 623.

Figure 18:
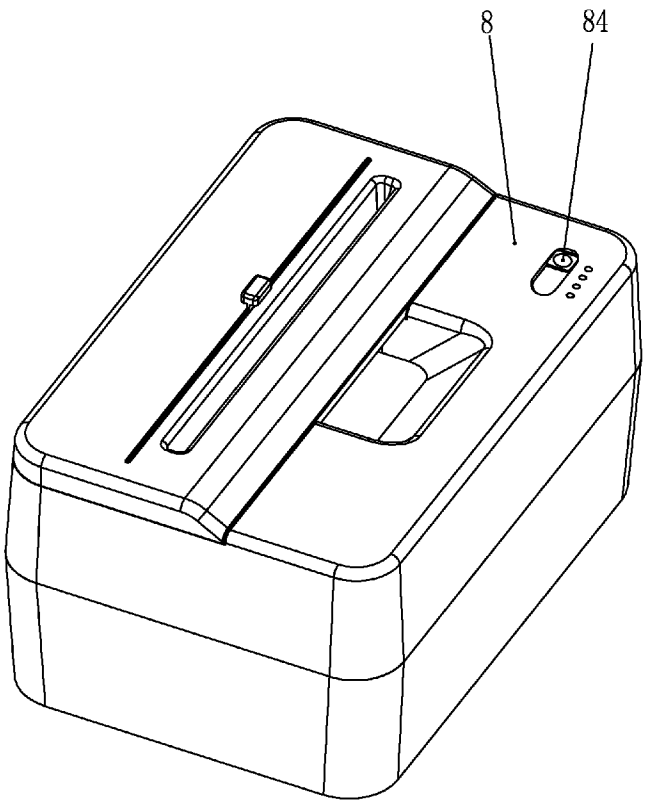
FIG. 18 is a three-dimensional view of the shredder being opened.
Figure 17:
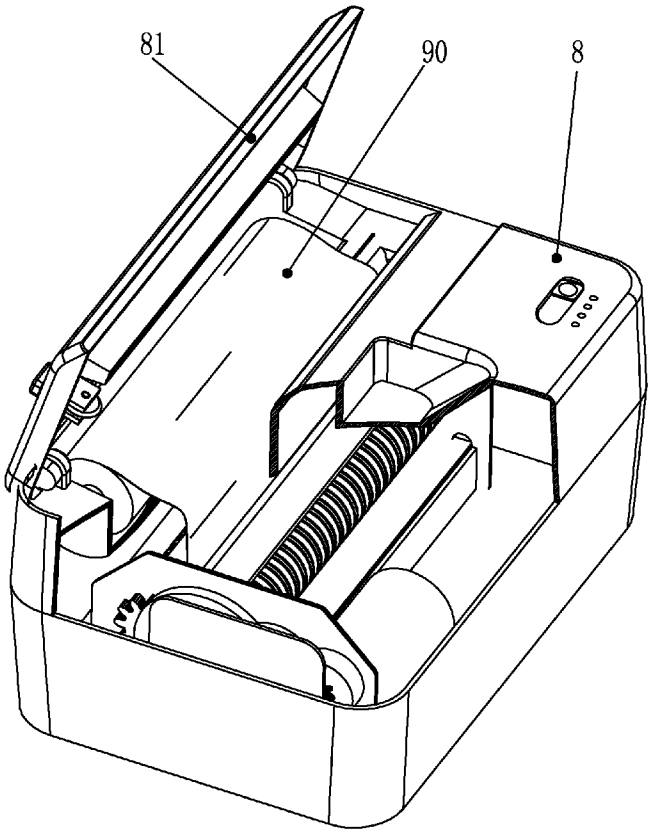
FIG. 17 is a three-dimensional view of the shredder.
Figure 19:
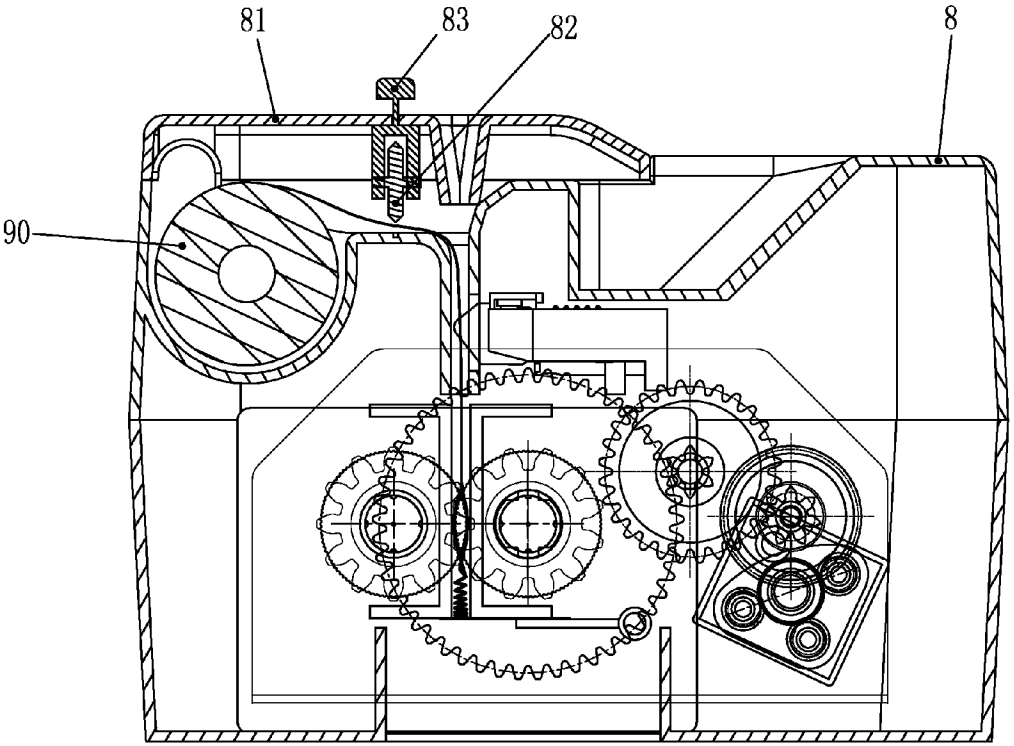
FIG. 19 schematically shows the internal structure of the shredder.

Please refer to FIGS. 17 to 19 that show the structure of the disclosed shredder. In contrast of putting paper sheet by sheet to make resilient crinkle paper, the invention allows continuous production of resilient crinkle paper.

The upper part of the housing 8 of the invention has a flipping lid 81. Specific rolling paper 90 is disposed inside the flipping cover 81. A cutting knife 82 is installed on the flipping lid. By pulling a handle 83, the cutting knife 82 starts high-speed rotations to cut the rolling paper 90. To automatically produce resilient crinkle paper, one only needs to open the flipping lid 81 and insert the rolling paper 90. Then one puts the beginning of the rolling paper into the paper passage 4. By turning on the switch 84, the invention starts its function to continuously generate crinkle paper. The power source of the rolling paper 90 can be the paper itself or from some gears and belts.

Figure 20:
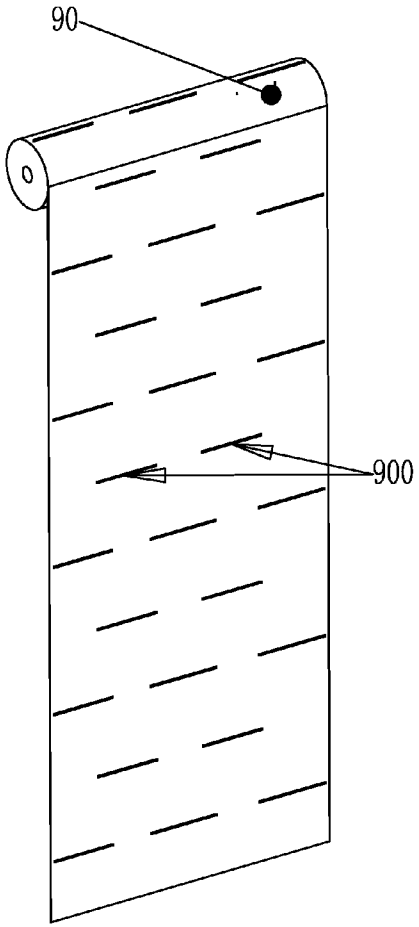
FIG. 20 is a schematic view of paper used by the shredder.

As shown in FIG. 20, this particular rolling paper 90 has cuts 900 by its vendor or some cutting machine. The cuts 900 alternate so that the resilient crinkle paper is in segments. Note that the cuts 900 can be arbitrarily arranged.

Figure 21:
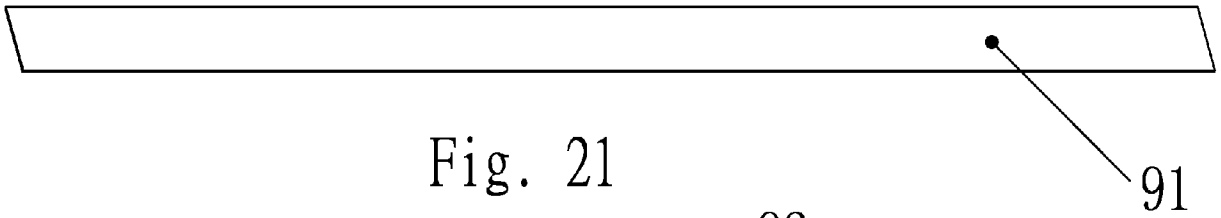
FIG. 21 schematically shows the paper stripes after cutting.

As shown in FIG. 21, a traditional shredder can cut a sheet of large-area paper into paper stripes 91. However, the invention can turn the paper stripes into resilient crinkle paper, as shown in FIG. 22. This kind of crinkle paper 92 is formed by repeatedly folding the paper stripes 91, attributing them the resilient nature like a spring. They can provide good buffer for packaging. Moreover, the resilient crinkle paper 92 can be used as fertilizers. Because of its resilience and empty space formed in between, the resilient crinkle paper 92 can provide sufficient air for fertilizer fermentation.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A shredder comprising:

a shaft set driven by a motor and comprised of at least two shafts rotating in opposite directions and with cutting blade sets mounted thereon;

a paper passage formed by the shafts;

a sliding switch hat to switch to a reverse mode;

a movable stopper provided at the exit of the paper passage; and a clearing mechanism;

wherein paper enters the entry of the paper passage and is cut by the cutting blades into paper strips; the paper strips are pushed down by the rotating blades toward the exit; the paper strips accumulate at the stopper so that crinkles form on the paper strips until the accumulated paper strips force the stopper to open, thereby letting the crinkled paper strips fall; the clearing mechanism is manual and includes the sliding switch hat, a pulling bar, a transmission shaft, a lock, a stopper, a restoring switch, a pulling spring, and a torsional spring; when the sliding switch hat switches to the reverse mode, the sliding switch hat unlocks and moves the stopper to open the exit also causing the restoring switch to become active, and when the reverse mode is switched off, the restoring switch is used to close the exit.

2. The shredder of claim 1, wherein the stopper is an elastic object that naturally blocks the exit of the paper passage, the stopper is pushed open by the gravity of paper stripes accumulated in the paper passage; or the stopper is driven by a driving device to rotate or translate horizontally, thereby opening the paper exit periodically or on demand.

3. A shredder comprising:

a shaft set driven by a motor and comprised of at least two shafts rotating in opposite directions and with cutting blade sets mounted thereon;

a paper passage formed by the shafts;

a sliding hat switch to switch to a reverse mode;

a movable stopper provided at the exit of the paper passage; and a clearing mechanism;

wherein paper enters the entry of the paper passage and is cut by the cutting blades into paper strips; the paper strips are pushed down by the rotating blades toward the exit; the paper strips accumulate at the stopper so that crinkles form on the paper strips until the accumulated paper strips force the stopper to open, thereby letting the crinkled paper strips fall; the clearing mechanism is semi-automatic includes the sliding switch hat, a pulling bar, a transmission shaft, a lock, a connecting bar, a cam, a pulling spring, and a restoring spring; the stopper is manually opened when the sliding hat switch is moved to the reverse mode thereby triggering the pulling bar to rotate and unlock the lock so that the pulling spring moves the stopper to open the exit and is automatically closed when the reverse mode is ended and the shredder runs forward so that the cam is pulled by the restoring spring to move the stopper to close the exit.

4. The shredder of claim 3, wherein the stopper is an elastic object that naturally blocks the exit of the paper passage, the stopper is pushed open by the gravity of paper stripes accumulated in the paper passage; or the stopper is driven by a driving device to rotate or translate horizontally, thereby opening the paper exit periodically or on demand.

5. A shredder comprising:

a shaft set driven by a motor and comprised of at least two shafts rotating in opposite directions and with cutting blade sets mounted thereon;

a paper passage formed by the shafts;

a movable stopper provided at the exit of the paper passage; and a clearing mechanism;

wherein paper enters the entry of the paper passage and is cut by the cutting blades into paper strips; the paper strips are pushed down by the rotating blades toward the exit; the paper strips accumulate at the stopper so that crinkles form on the paper strips until the accumulated paper strips force the stopper to open, thereby letting the crinkled paper strips fall; the clearing mechanism is fully automatic and includes a pulling claw, a pulling bar, a spiral guiding groove, and a guiding plate so that when the shredder runs in reverse, the spiral guiding groove is driven by the guiding plate and displaces the pulling claw outward to push the pulling bar thereby moving the stopper and opening the exit, and when the shredder runs forward the pulling bar is pulled thereby closing the exit.

6. The shredder of claim 5, wherein the stopper is an elastic object that naturally blocks the exit of the paper passage, the stopper is pushed open by the gravity of paper stripes accumulated in the paper passage; or the stopper is driven by a driving device to rotate or translate horizontally, thereby opening the paper exit periodically or on demand.

7. A shredder comprising:

a shaft set driven by a motor and comprised of at least two shafts rotating in opposite directions and with cutting blade sets mounted thereon;

a paper passage formed by the shafts;

a movable stopper provided at the exit of the paper passage; and a clearing mechanism;

wherein paper enters the entry of the paper passage and is cut by the cutting blades into paper strips; the paper strips are pushed down by the rotating blades toward the exit; the paper strips accumulate at the stopper so that crinkles form on the paper strips until the accumulated paper strips force the stopper to open, thereby letting the crinkled paper strips fall; the clearing mechanism is fully automatic and includes forward and reverse pulling claws, a first and second pulling bar, and one-way bearings so that when the shredder runs in reverse, the reverse pulling claw drives the first pulling bar and the stopper to open the exit, and when the shredders runs forward the forward pulling claw drives the second pulling bar and the stopper to close the exit.

8. The shredder of claim 7, wherein the stopper is an elastic object that naturally blocks the exit of the paper passage, the stopper is pushed open by the gravity of paper stripes accumulated in the paper passage; or the stopper is driven by a driving device to rotate or translate horizontally, thereby opening the paper exit periodically or on demand.

9. A shredder comprising:

a shaft set driven by a motor and comprised of at least two shafts rotating in opposite directions and with cutting blade sets mounted thereon;

a paper passage formed by the shafts;

a movable stopper provided at the exit of the paper passage; and a clearing mechanism;

wherein paper enters the entry of the paper passage and is cut by the cutting blades into paper strips; the paper strips are pushed down by the rotating blades toward the exit; the paper strips accumulate at the stopper so that crinkles form on the paper strips until the accumulated paper strips force the stopper to open, thereby letting the crinkled paper strips fall; when the shredder is in the reverse mode, the clearing mechanism is triggered automatically by a reverse claw which interacts with a first one way pawl to cause a first pulling rod to move in a first direction relative to a second pulling rod thereby allowing the second pulling rod to move the stopper and open the exit, so that the paper can back out without pressure from the stopper; and when the shredder resumes forward operation, the stopper is closed automatically by a forward claw which interacts with a second one way pawl to cause the first pulling rod to move in a second direction relative to the second pulling rod thereby forcing the second pulling rod to move the stopper and close the exit.

10. The shredder of claim 9, wherein the stopper is an elastic object that naturally blocks the exit of the paper passage, the stopper is pushed open by the gravity of paper stripes accumulated in the paper passage; or the stopper is driven by a driving device to rotate or translate horizontally, thereby opening the paper exit periodically or on demand.

* * * * *